US008480188B2

(12) United States Patent
Cao et al.

(10) Patent No.: US 8,480,188 B2
(45) Date of Patent: Jul. 9, 2013

(54) COMPUTER DESK ASSEMBLY

(75) Inventors: Xiang Cao, Shenzhen (CN); Hai-Qing Zhou, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 106 days.

(21) Appl. No.: 13/220,821

(22) Filed: Aug. 30, 2011

(65) Prior Publication Data

US 2012/0250239 A1 Oct. 4, 2012

(30) Foreign Application Priority Data

Mar. 31, 2011 (CN) ..... 2011 1 0080356

(51) Int. Cl.
*A47B 41/00* (2006.01)

(52) U.S. Cl.
USPC ..... 312/223.3; 108/50.02; 312/304

(58) Field of Classification Search
USPC ..... 312/223.3, 194–196, 7.2, 312, 306, 312/304, 319.1, 21, 29, 30; 108/50.01, 50.02, 108/25, 26, 136, 137
See application file for complete search history.

(56) References Cited

U.S. PATENT DOCUMENTS

| | | | | | |
|---|---|---|---|---|---|
| 1,779,327 | A * | 10/1930 | Moss | 232/43.2 |
| 2,599,642 | A * | 6/1952 | Kato | 108/84 |
| 2,768,047 | A * | 10/1956 | Strauss | 312/242 |
| 3,066,993 | A * | 12/1962 | Mark | 312/306 |
| 3,373,703 | A * | 3/1968 | Barecki | 108/50.01 |
| 3,781,074 | A * | 12/1973 | Trueblood | 312/30 |
| 4,050,754 | A * | 9/1977 | Coley | 312/233 |
| 4,700,993 | A * | 10/1987 | Fu-Long | 312/312 |
| 5,415,010 | A * | 5/1995 | Woo | 62/258 |
| 6,553,919 | B1 * | 4/2003 | Nevin | 108/50.01 |
| 7,578,243 | B2 * | 8/2009 | Gevaert | 108/25 |
| 7,926,430 | B2 * | 4/2011 | Bakker et al. | 108/50.02 |
| 8,037,832 | B2 * | 10/2011 | Pellegrini | 108/50.01 |
| 2006/0162626 | A1 * | 7/2006 | Brauning et al. | 108/143 |
| 2010/0090075 | A1 * | 4/2010 | Griffin | 248/222.14 |
| 2010/0326329 | A1 * | 12/2010 | Kiekhaefer | 108/25 |
| 2011/0297051 | A1 * | 12/2011 | Martin et al. | 108/25 |

* cited by examiner

*Primary Examiner* — Janet M Wilkens
(74) *Attorney, Agent, or Firm* — Altis Law Group, Inc.

(57) ABSTRACT

A computer desk assembly includes a desk and a display. The desk defines a receiving groove in a top thereof. The desk includes two sliding plates movably engaging in the receiving groove. The display is in the receiving groove of the desk and pivotably connected to the desk. When the computer desk assembly is in a first state, the sliding plates are disposed above the display. When the computer desk assembly is in a second state, the sliding plates slide laterally to expose the display, whereby the display is rotated up relative to the desk for use.

13 Claims, 5 Drawing Sheets

COMPUTER DESK ASSEMBLY

BACKGROUND

1. Technical Field

The disclosure relates to computer desk assemblies, and particularly to a computer desk assembly with a movable display which can be received in a desk.

2. Description of the Related Art

Due to various computer accessories and equipment being readily available, it is becoming increasingly difficult to fit a whole computer system on the same desk while having space for reading or writing.

What is desired, therefore, is a computer desk assembly which can overcome the above-described shortcoming.

DETAILED DESCRIPTION

Figure 1:
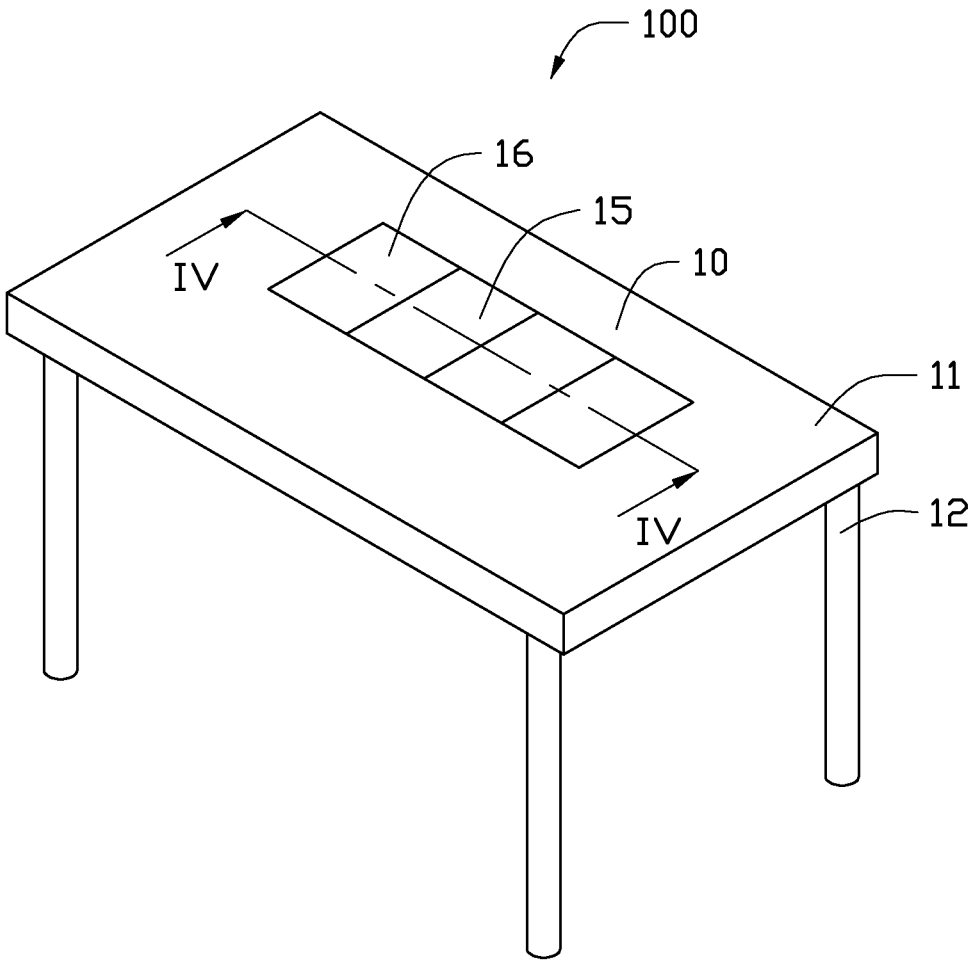
FIG. 1 is a schematic, isometric, assembled view of a computer desk assembly.

Reference will now be made to the drawing figures to describe the present electronic device in detail.

Figure 2:
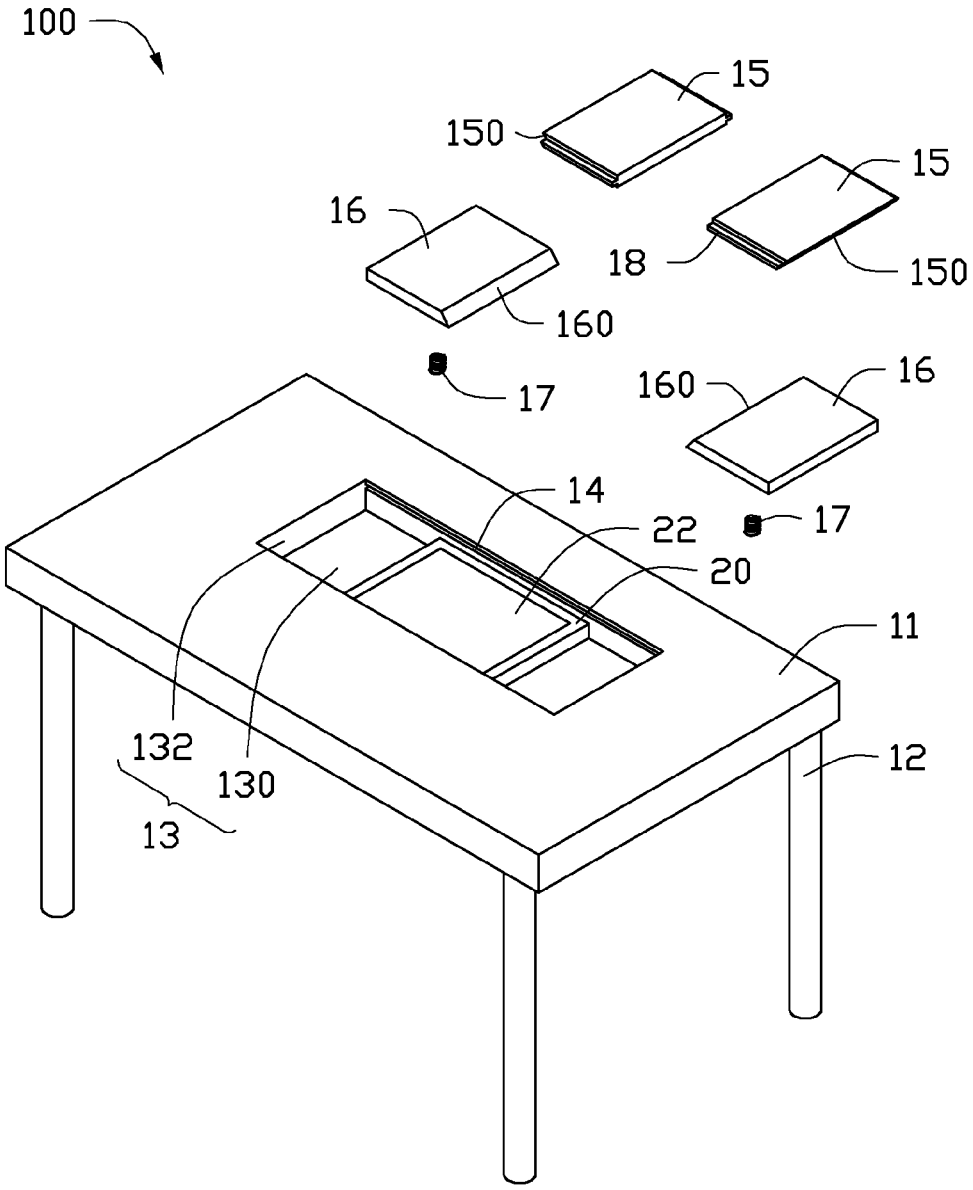
FIG. 2 is an exploded view of the computer desk assembly of FIG. 1.

Referring to FIGS. 1-2, a computer desk assembly 100 includes a desk 10 and a display 20 mounted in the desk 10. The desk 10 includes a body 11 and four legs 12 extending downwards from four corners of the body 11. The body 11 is rectangular-shaped. An upper surface of the body 11 defines a receiving groove 13. The body 11 includes a bottom wall 130 and four sidewalls 132 connected to the bottom wall 130. The bottom wall 130 and the sidewalls 132 enclose the receiving groove 13. The opposite front and rear sidewalls 132 each define a guiding recess 14. Each of the guiding recesses 14 horizontally extends in a straight line. The display 20 is received in a middle portion of the receiving groove 13. The display 20 includes a screen 22 facing a top of the desk 10 therein.

Figure 3:
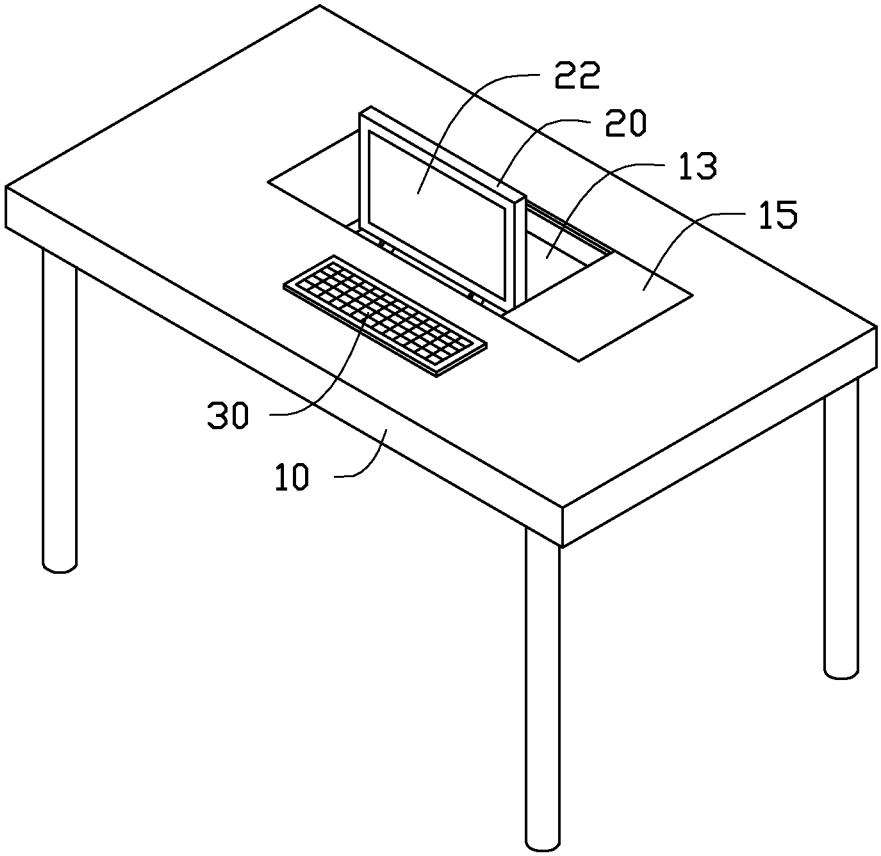
FIG. 3 is an assembled view of the computer desk assembly of FIG. 1, but showing the computer desk assembly in a second state.

Referring also to FIG. 3, the display 20 is pivotably connected with the body 11. In this embodiment, a front side of the display 20 is pivotably connected with the bottom wall 130. The display 20 can rotate with respect to the body 11 and can be lifted up from the receiving groove 13.

Figure 4:
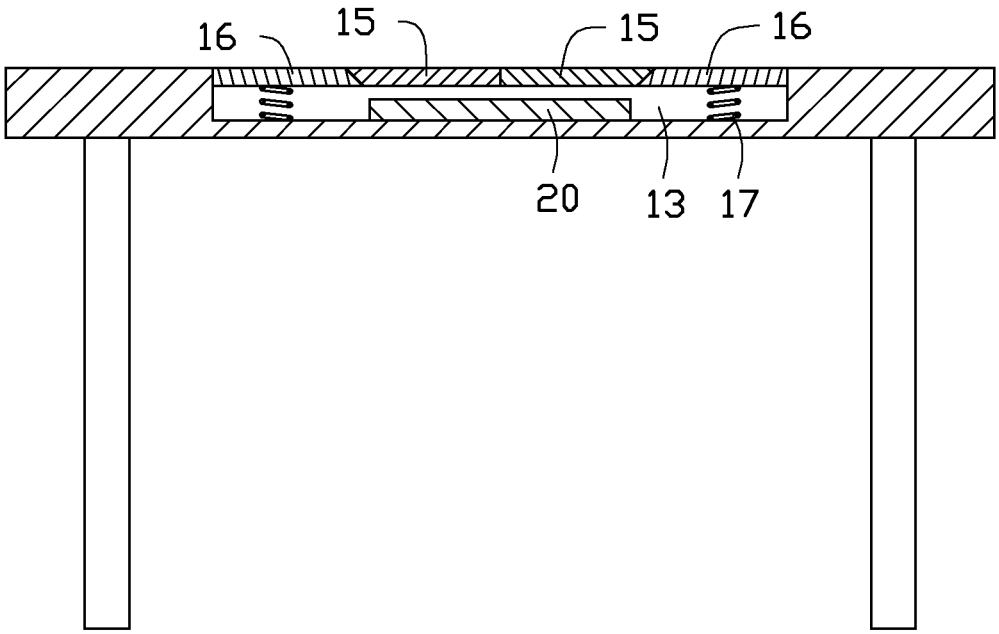
FIG. 4 is a cross-sectional view along a line IV-IV of the computer desk assembly seen in FIG. 1.

Referring to FIG. 4, the desk 10 includes two sliding plates 15, two movable members 16, and two elastic members 17. The sliding plates 15 are received in the receiving groove 13 and movable with respect to the body 11. Each of the sliding plates 15 is rectangular-shaped. Each of the sliding plates 15 has two extending portions 18 extending from the front and rear edges thereof. The extending portions 18 are received in the guiding recesses 14 of the sidewalls 132, and are movable in the receiving groove 13 of the body 11. The sliding plates 15 are juxtaposed to each other. The sliding plates 15 each have a pressing surface 150 at an end away from the other sliding plate 15. The pressing surface 15 of each sliding plate 15 is inclined downwards. The movable members 16 are received in the receiving groove 13 of the body 11 sandwiching the sliding plates 15. Each of the movable members 16 is rectangular-shaped and has an engaging surface 160 relative to the pressing surface 150 of the adjacent sliding plate 15. The engaging surface 160 of each movable member 16 is inclined upwards. In this embodiment, each of the elastic members 17 is a compressing spring with a bottom end connecting to the bottom wall 130 and an upper end connecting the movable member 16. Therefore, the movable members 16 can move up and down in the receiving groove 13.

When the computer desk assembly 100 is in a first state, shown in FIGS. 1 and 4, the whole display 20 is received in the receiving groove 13. Surfaces of the sliding plates 15 and the movable members 16 are coplanar with a top of surface body 11. The sliding plates 15 are engaged in the guiding recesses 14 of the sidewalls 132 and located over the screen 22 of the display 20. The engaging surfaces 160 of movable members 16 upwardly engage the pressing surfaces 150 of the sliding plates 15, thus the movable members 16 upwardly support the sliding plates 15. The elastic members 17 upward support the movable members 16.

Figure 5:
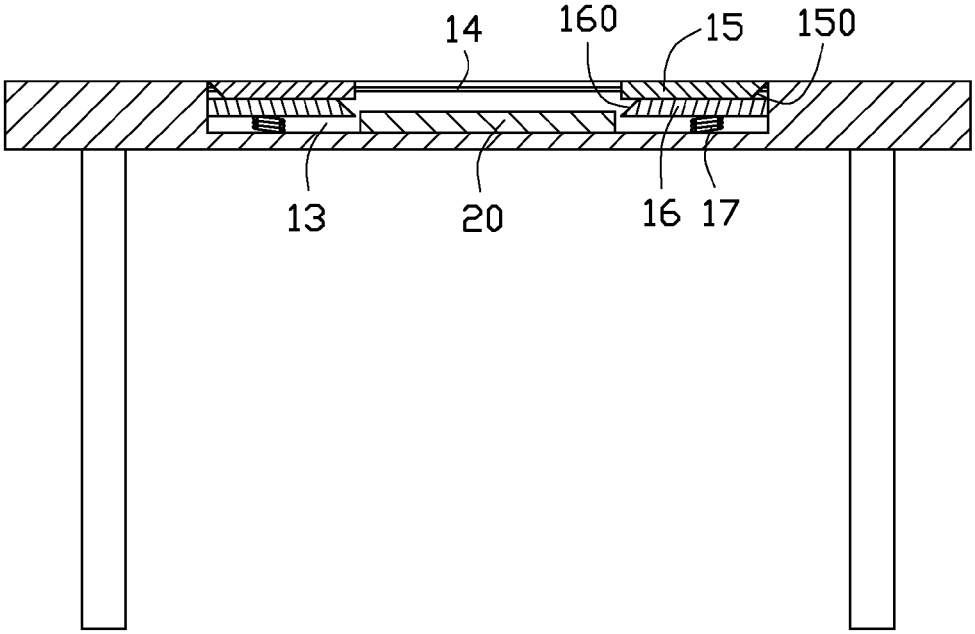
FIG. 5 is a similar view as FIG. 4, but with opened sliding plates to expose a display of the computer desk assembly.

When the computer desk assembly 100 in a second state, shown in FIG. 5, the display 20 is in use. The sliding plates 15 are moved horizontally to the lateral sidewalls 132 along the guiding recesses 14 in opposite directions. Each of the sliding plates 15 push down the corresponding movable member 16 by the pressing surface 150 whereby the elastic members 17 are pressed and the movable members 16 go down. When the sliding plates 15 are pulled from the middle portion to two sides of the receiving groove 13 and located on the corresponding movable members 16, the display 20 is exposed from the receiving groove 13. The display 20 is rotated relative to the bottom wall 130 and beyond the top surface of the body 11. As such, the display 20 can be used by the user, as shown in FIG. 3. In this way, the space can be utilized effectively. When not in use, the display 20 can rotate to be received in the receiving groove 13 and the sliding plates 15 are pulled to slide to a top of the display 20. Thus, when the movable members 16 are not pressed the movable members 16 are pushed upward by the elastic members 17. The sliding plates 15 and the movable members 16 resumes the first state and the desk 11 forms a flat top.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A computer desk assembly, comprising:

a desk defining a receiving groove in a top thereof, the desk comprising two sliding plates movably engaging in the receiving groove; and a display in the receiving groove of the desk, the display being pivotable relative to and connected to the desk;

wherein when the computer desk assembly is in a first state, the sliding plates are disposed above the display; and when the computer desk assembly is in a second state, the sliding plates slide laterally to expose the display, thereby the display being rotated up relative to the desk for use; and wherein the desk has a bottom wall and four sidewalls around the bottom wall in the receiving groove, two opposite sidewalls each defining a guiding recess to receive opposite edges of the sliding plates.

2. The computer desk assembly of claim 1, wherein each of the sliding plates has two extending portions extending from the opposite edges thereof and received in the guiding recesses of the desk.

3. The computer desk assembly of claim 1, wherein the desk further comprises two movable members and two elastic member each connecting the corresponding movable member with the desk, the movable members having top surfaces coplanar with the top surface of the desk in the first state, the movable members each being pressed by the corresponding sliding plate in the second state.

4. The computer desk assembly of claim 3, wherein each of the sliding plates has a pressing surface at an end thereof adjoining to the movable member, the pressing surfaces being defined inclined and inward.

5. The computer desk assembly of claim 4, wherein each of the movable members has an engaging surface at an end thereof corresponding to the pressing surface of corresponding sliding plate, the engaging surface being defined inclined and outward.

6. A computer desk assembly, comprising:

a desk defining a receiving groove in a top thereof, the desk comprising a sliding plate movably engaging in the receiving groove, a movable member received in the receiving groove, and an elastic member connecting the movable member with the desk; and a display in the receiving groove of the desk, the display being pivotable relative to and connected to the desk and located at a side of the movable member;

wherein when the computer desk assembly is in a first state, the sliding plate is disposed above the display, and the movable member is pushed upward by the elastic member and beside the sliding plate; and when the computer desk assembly is in a second state, the sliding plate slides to press the movable member down, thereby the display being rotated up from the receiving groove relative to the desk for use.

7. The computer desk assembly of claim 6, wherein the desk has a bottom wall and four sidewalls around the bottom wall in the receiving groove, two opposite sidewalls each defining a guiding recess to receive opposite edges of the sliding plate.

8. The computer desk assembly of claim 7, wherein each of the guiding recesses horizontally extends in a straight line.

9. The computer desk assembly of claim 7, wherein the sliding plate has two extending portions extending from the opposite edges thereof into the guiding recesses of the desk.

10. The computer desk assembly of claim 6, wherein the sliding plate has a pressing surface at an end thereof adjoining to the movable member, the pressing surface being defined inclined and inward.

11. The computer desk assembly of claim 10, wherein the movable member has an engaging surface at an end thereof corresponding to the pressing surface of the sliding plate, the engaging surface being defined inclined and outward.

12. The computer desk assembly of claim 6, wherein the desk further comprises an additional sliding plate, an additional movable member engaging the additional sliding plate, and an additional elastic member connecting the additional movable member with the desk, the additional sliding plate and the sliding plate sandwiching the display.

13. A computer desk assembly, comprising:

a desk defining a receiving groove in a top thereof, the desk comprising two sliding plates movably engaging in the receiving groove; and a display in the receiving groove of the desk, the display pivotably connected to the desk;

wherein when the computer desk assembly is in a first state, the sliding plates are disposed above the display; and when the computer desk assembly is in a second state, the sliding plates slide laterally to expose the display, thereby the display being rotated up relative to the desk for use; and wherein the desk further comprises two movable members and two elastic member each connecting the corresponding movable member with the desk, the movable members having top surface coplanar with the top surface of the desk in the first state, the movable members each being pressed by the corresponding sliding plate in the second state.

* * * * *